United States Patent [19]

Simoncelli

[11] Patent Number: 4,942,694

[45] Date of Patent: Jul. 24, 1990

[54] FITTINGS FOR DOORS, WINDOWS OR THE LIKE

[75] Inventor: Philippe Simoncelli, Hoff, France

[73] Assignee: Ferco International Usine de Ferrures de Batiment, Sarrebourg, France

[21] Appl. No.: 409,757

[22] Filed: Sep. 20, 1989

[30] Foreign Application Priority Data

Sep. 26, 1988 [FR] France ..... 88 12721
Mar. 14, 1989 [FR] France ..... 89 03577

[51] Int. Cl.[5] ..... E05D 15/52
[52] U.S. Cl. ..... 49/192; 49/254
[58] Field of Search ..... 49/192, 254

[56] References Cited

U.S. PATENT DOCUMENTS 3,667,162 6/1972 Lalague ..... 49/192
4,339,892 7/1982 Ulbricht et al. ..... 49/192
4,541,200 9/1985 Gartner ..... 49/192
4,602,457 7/1986 Kreusel ..... 49/192

*Primary Examiner*—Philip C. Kannan
*Attorney, Agent, or Firm*—Sandler, Greenblum & Bernstein

[57] ABSTRACT

A fitting for doors, windows or the like, comprising locking means, in particular, a casement bolt or espagnolette lock, for locking the wing (9) against the fixed frame (11), and acting on hinged fittings consisting of a corner bearing (2) and a casement stay (3) disposed in rabbets, so that the said wing (9) can be opened at least inwardly and disposed in a ventilation position, this fitting moreover being provided with control means (21) for opening the wing (9), starting from the closed position, into the ventilation position, followed by inward opening of said wing, by acting successively on the locking means.

19 Claims, 3 Drawing Sheets

FITTINGS FOR DOORS, WINDOWS OR THE LIKE

Figure 1:
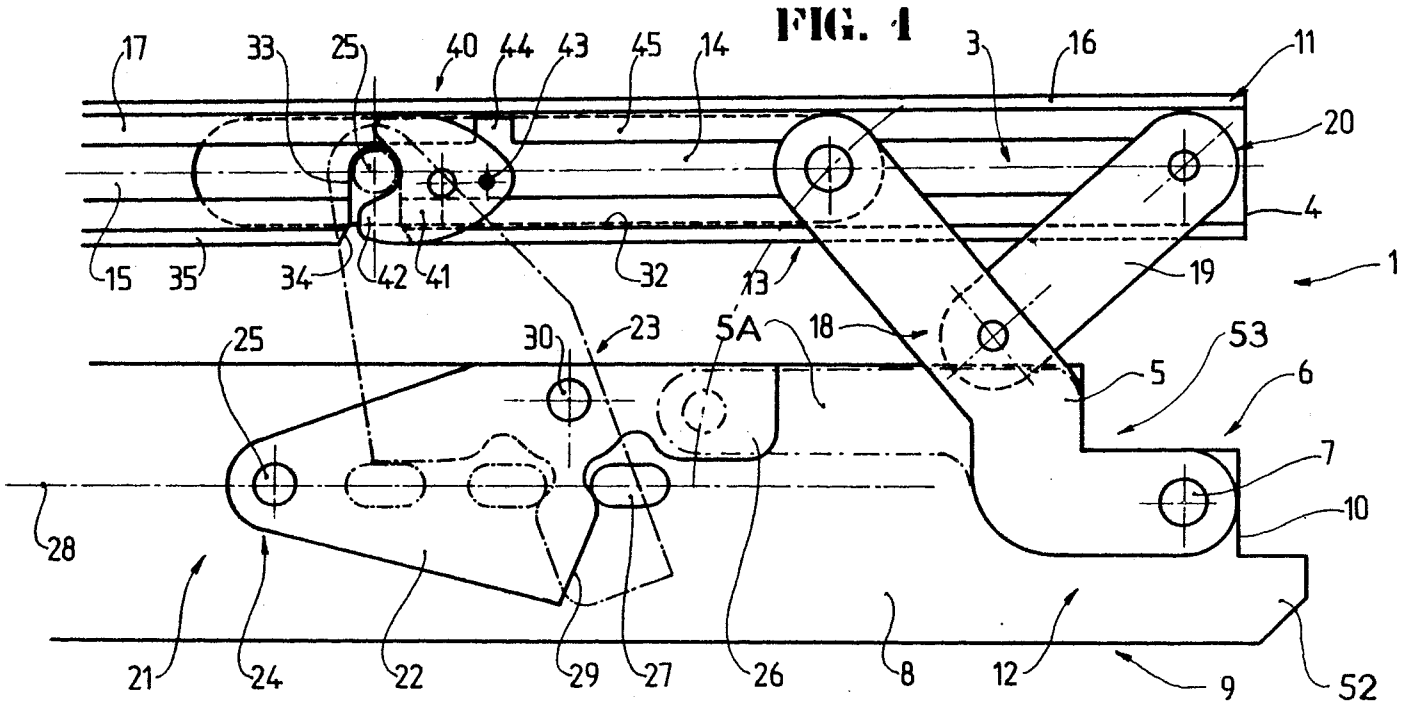

The invention relates to a fitting for doors, windows or the like, comprising locking means, such as a casement bolt or espagnolette lock, for locking the wing against the fixed frame, and acting on hinged fittings consisting of a corner bearing and a casement stay disposed in rabbets, so that the said wing can be opened at least inwardly and disposed in a ventilation position.

This invention will be used more particularly in specialised industry in the building hardware sector.

A number of fittings suitable for doors, windows or the like are already known, comprising, inter alia, hinged fittings consisting of a corner bearing and a casement stay for the lower and upper connections of the opening frame of the door, window or the like against its fixed frame. In general, these fittings moreover comprise locking means and, in particular, a casement bolt or espagnolette lock for keeping the wing locked against the frame. The function of these casement bolts or espagnolette locks consists moreover in controlling the manner of opening of the door or window by acting on their hinged fittings. In particular, by virtue of the design of the casement stay inserted in the upper part of the door or window, the wing can rotate about a vertical axis, corresponding to opening inwards, on the one hand, and, on the other hand, can pivot into a tilted position.

The corner bearing disposed in the lower corner of the door or window allows, alternately, tilting of the wing about a horizontal axis and pivoting of same about a vertical axis of rotation.

A door or window which can be opened in this manner is generally known as a pivoting and tiltable door or window. However, there are of course other opening methods according to which the wing can be moved into a completely or partially open position, as the case may be. In particular, in the sphere of sliding doors or windows, there are known fittings moreover allowing the wing to be displaced in a perpendicular direction in relation to the fixed frame.

There is a tendency at present, particularly in pivoting and tiltable systems, to fit the hinged fittings into the rabbets of the door or window. However, this does pose a number of problems, particularly with respect to the mechanical behaviour of these hinged fittings when they are associated with wings of considerable weight and size, and, moreover, when the said opening frame partially overlaps the fixed frame.

Disposing the hinged fittings in rabbets necessarily limits the cross-section of the components forming part of their mechanisms. The peripheral lip which is provided on the opening frame and bears against the inner face of the fixed frame in the closed position, means that the axis of rotation of this wing must be displaced outside the vertical plane of the said fixed frame.

Therefore, hinged fittings have been designed for pivoting and tiltable doors or windows, consisting of a corner bearing and a casement stay fixed in rabbets and each comprising an auxiliary stay arm connected, on the one hand, to the bottom rail and top rail respectively of the fixed frame, and, on the other hand, respectively to the bottom rail of the wing of the door or window and to a principal stay arm cooperating with the top rail of the said wing. The principal stay arm forming part of the design of the casement stay serves, more particularly, to limit the pivot amplitude of the door or window into the tilted open position. Therefore, this principal stay arm is fixed in relation to the top rail of the wing or is held on the latter in such a way that it can move freely in rotation or in translation, according to whether the operator wishes to bring the door or window into the ventilation position or into the inwardly open position.

Moreover, the corner bearing and the casement stay comprise a second stay arm slidably mounted at one of its ends on the bottom rail and top rail respectively of the fixed frame, the other end being connected by means of a hinge to the bottom rail of the opening frame and to the principal stay arm respectively. In addition, a connecting rod, forming part of the corner bearing and the casement stay, connects the second stay arm to the bottom or top rail of the said fixed frame.

The major disadvantages of these known hinged fittings consist essentially in that the opening angle of the wing in relation to the fixed frame is necessarily limited or is scarcely greater than ninety degrees. In any case, it is impossible to open the door or window one hundred and eighty degrees.

In addition, the opening operation actuated by means of the casement bolt or espagnolette lock results initially in inward opening of the door or window, followed by the ventilation position. This may be the conventional order, but it is by no means the logical one, as it is in fact preferable to obtain the ventilation position after one movement rather than a position according to which the wing is completely open, firstly for the sake of convenience and secondly, for increased safety.

More precisely, if the operator is not careful when locking the door or window, and starting from an aeration position, partial actuation of the casement bolt or espagnolette lock can lead to complete opening of the door or window, thus facilitating the entry of an intruder into the dwelling.

Finally, the design of these hinged fittings is dependent on the locking control mechanisms of the door or window. Therefore, this design of the hinged fittings will differ according to whether the casement bolt is provided with unidirectional or bidirectional operating rods. This means that it is impossible to standardise the design of these hinged fittings.

The object of this invention is to mitigate all of the aforementioned disadvantages by proposing a fitting for doors, windows or the like adapted to give the latter an angle of rotation equal to ninety degrees when they are opened inwardly. In addition, the associated hinged fittings are designed in such a way that they can cooperate with any type of control mechanism, such as a casement bolt or espagnolette lock having unidirectional or bidirectional operating rods.

Another object of this invention consists in proposing a corner bearing and a casement stay constituting these hinged fittings, which are of identical design and which not only can be inverted with respect to a horizontal mid plane of the door or window, but also can be used to the right or to the left of the latter.

One of the principal objects of this invention consists in proposing a fitting for doors, windows or the like, adapted to give the latter a partially open position, known as a ventilation position, and a completely open position, where it opens inwardly, its control mechanism allowing these opening methods to be selected in the aforementioned order.

This problem is solved according to the invention as it is characterised in the claims in that a fitting is provided for doors, windows or the like, comprising locking means, such as a casement bolt or espagnolette lock, for locking the wing against the fixed frame, and acting on hinged fittings consisting of a corner bearing and a casement stay disposed in rabbets, so that the said wing can be opened at least inwardly and disposed in a ventilation position, this fitting comprising control means for opening the wing, starting from the closed position, into the ventilation position, followed by inward opening of said wing, by acting successively on the locking means.

Figure 2:
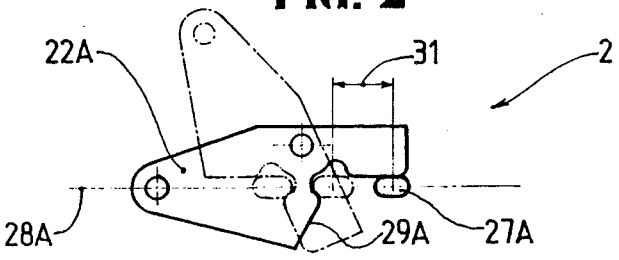
Figure 5:
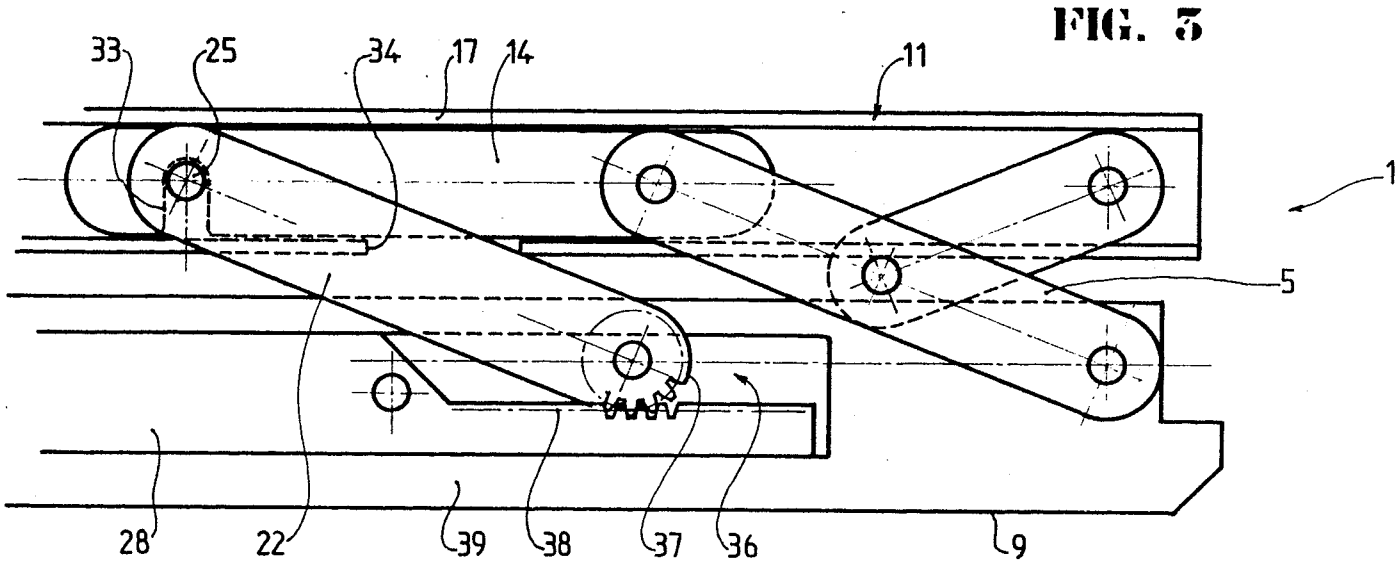
Figure 4:
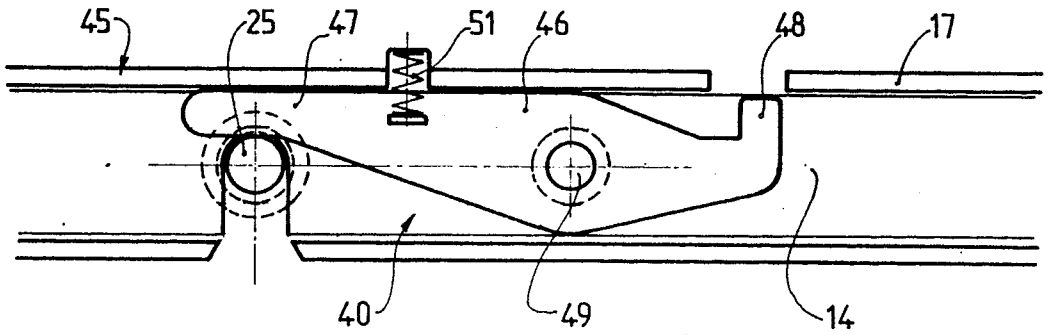
Figure 5:
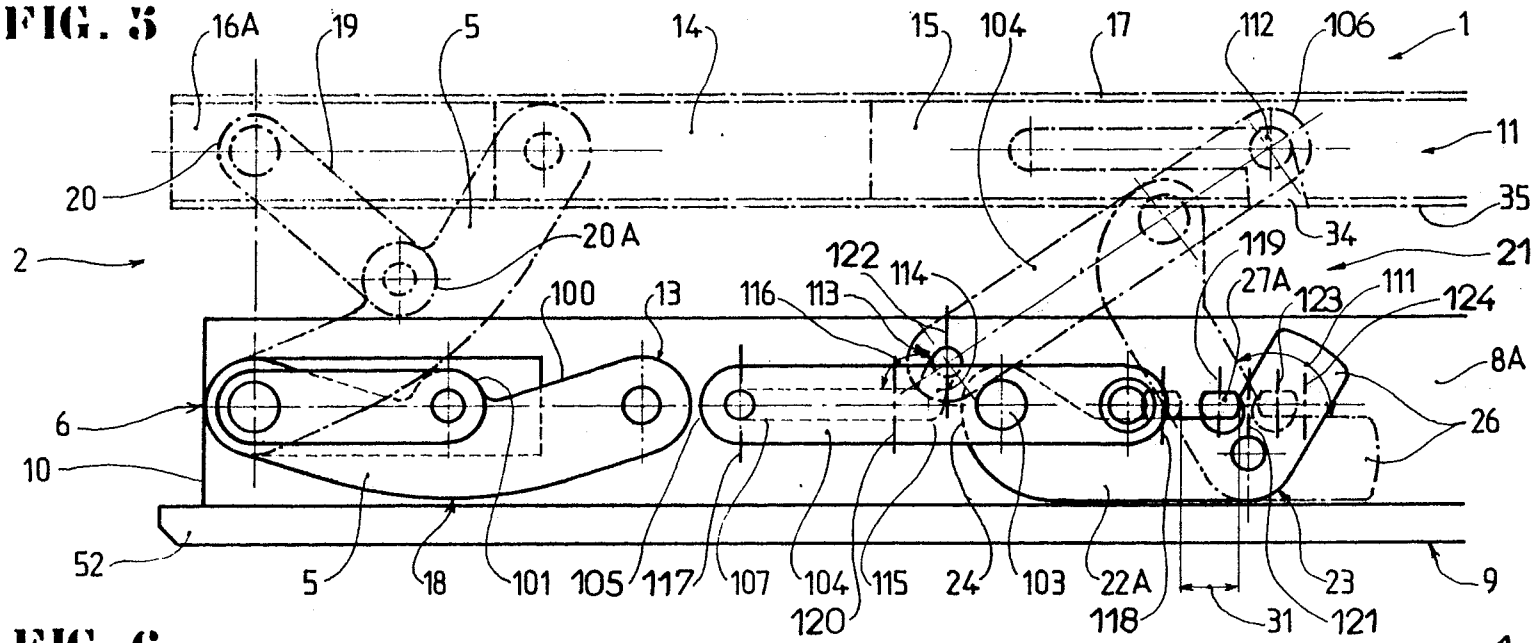
Figure 6:
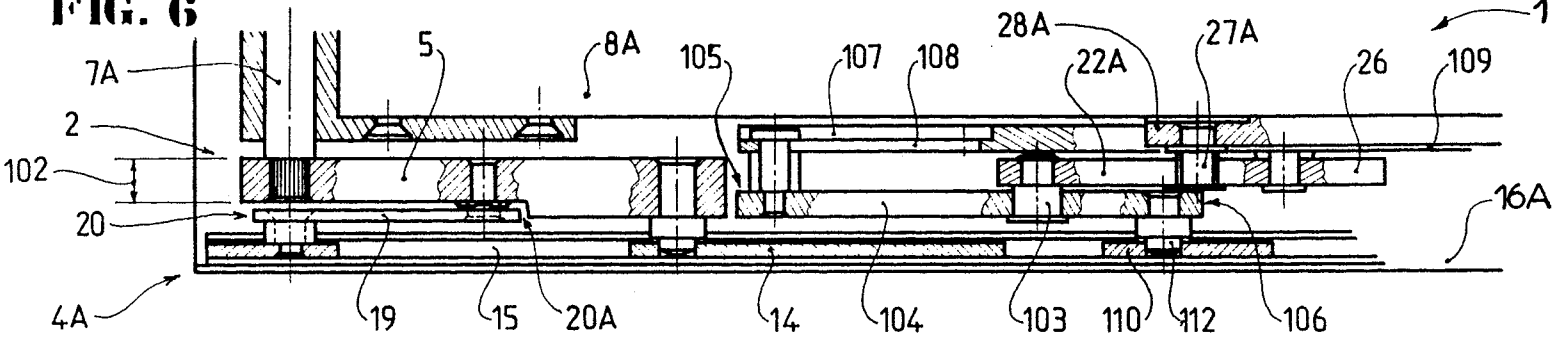

The invention will now be described in more detail with reference to the accompanying drawings, which show only particular embodiments, and in which:

FIG. 1 shows a schematic plan view of the casement stay inserted in the upper corner of the door, window or the like, FIG. 2 shows a schematic plan view of the connecting bar corresponding to the corner bearing and cooperating with the controlling members of the casement bolt or espagnolette lock, FIG. 3 shows a view identical to that of FIG. 1, but corresponding to a second embodiment of the hinged fittings, FIG. 4 shows a schematic plan view of a second embodiment of the means adapted to fasten certain components forming part of the hinged fittings when the door or window is opened inwardly, FIG. 5 shows a schematic plan view of the corner bearing inserted in the lower corner of the door, window or the like and corresponding to a third embodiment of the hinged fittings constituting the fitting according to the invention, and FIG. 6 shows a schematic section of the corner bearing illustrated in FIG. 5.

This invention relates to a fitting for doors, windows or the like, offering the possibility of moving the wing of the latter at least into an inwardly open position and into an aeration position known as a ventilation position. Therefore, this fitting comprises locking control means, and, in particular, a casement bolt or espagnolette lock (not shown) adapted to select the method of opening, playing a part in the operation of the hinged fittings 1. These hinged fittings 1 consist of a corner bearing 2 and a casement stay 3 inserted in the lower and upper corners 4 respectively of the said door, window or the like.

Advantageously, and according to one characteristic of this invention, the corner bearing 2 and the casement stay 3 are of strictly identical design. For this reason, only the casement stay 3 has been illustrated in more detail in FIGS. 1 and 3 corresponding to separate embodiments, while FIGS. 5 and 6 show a corner bearing 2 realised according to a third embodiment also applicable to the casement stay. However, it may prove that the action of the control means of the casement bolt or espagnolette lock differs according to whether it is positioned at the said corner bearing 2 or at the said casement stay 3. Therefore, FIG. 2 shows the components constituting the corner bearing 2 realised according to the embodiment of FIG. 1 and cooperating with the said control means adapted to select the inward opening method or the ventilation position for the door, window or the like.

Therefore, according to the invention, the casement stay 3 or the corner bearing 2 comprises a principal stay arm 5 connected at one of its ends 6, by means of a hinge 7, 7A, to the top rail 8 or bottom rail 8A, as the case may be, of the wing 9 of the door, window or the like. More precisely, this connection between the principal stay arm 5 and the wing 9 is preferably situated as close as possible to the rear edge 10 of the said wing. An arrangement of this kind prevents there being too great a displacement of the wing 9 outside the fixed frame 11 when it is opened inwardly.

Advantageously, this end 6 of the principal stay arm 5 can be bent at a right angle as illustrated in FIG. 1 in order to follow the exact shape of the profile constituting the rear stile 12 of the wing 9 and, in particular, of the covering lip 52 provided on the said wing when it is opened inwardly to the maximum degree. More precisely, by virtue of this configuration, during the pivoting of the wing 9, the said covering lip 52 can position itself in the lower corner 53 of this bent end 6 of the principal stay arm 5, thus allowing opening of the door, window or the like at least equal to 180 degrees.

However, as is indicated by a continuous line in FIG. 1, the bend formed by the principal stay arm 5 necessitates machining of the inner face of the covering lip 52, so that it does not hinder the closing of the wing 9. Therefore, FIG. 1 also shows, by means of a broken line and in the closed position, a principal stay arm 5A whose form and structure is similar to a right-angled "Z" and prevents the necessity for any additional machining of the opening frame. However, with a principal stay arm 5A of this kind, it is possible to retain the advantage of the wing 9 opening 180 degrees.

In the case of the embodiment illustrated in FIGS. 5 and 6, this principal stay arm 5 is substantially curved. The object of this special configuration is better distribution of the weight of the wing 9 over the said principal stay arm 5, and this particularly at the start of the opening or closing operation of the door, window or the like.

In addition, it makes it possible to reduce the general space occupied by the corner bearing 2 and the casement stay 3 in the rabbet of the door, window or the like and prevents the necessity to cut a slot into the covering lip 53 of the wing 9.

It will be noted, moreover, that as a result of the small space occupied by the hinged fittings in the rabbets of the door, window or the like, the principal stay arm 5 can have sufficient thickness 102, particularly at the corner bearing 2, to support the weight of certain large wings.

Preferably, and according to the invention, the other end 13 of this principal stay arm 5 is pivotally mounted on a slide 14 moving in a groove 15 provided either in the top rail 16 or bottom rail 16A of the fixed frame 11, or in a shaped section 17 added to the said top rail 16 or bottom rail 16A.

It will be clear from the preceding description that when thrust is exerted on the said slide 14, of both the corner bearing 2 and the casement stay 3, this thrust reverberates on the principal stay arm 5, resulting in the wing 9 being displaced in a perpendicular direction in relation to the fixed frame 11.

However, it is advisable to ensure that this pressure exerted on the slide 14 is completely transmitted, by means of the principal stay arm 5, to the wing 9 in a direction perpendicular to the plane of the door or window, thereby preventing the said wing 9 from being displaced in parallel with the fixed frame 11. To this end, the principal stay arm 5 is connected in its central portion 18 to a secondary arm 19 hinged at its end 20 on to the top rail 16 or bottom rail 16A of the fixed frame 11.

It will be noted that in the case of a curved principal stay arm 5, said arm 5 comprises in its central portion 18 and on its lateral edge 100 having small radii of curvature, an eyelet playing a part in the connection with the end 20A of the secondary arm 19.

In any case, such a displacement of the wing 9 in relation to the fixed frame 11 by means of the principal stay arm 5 must be obtained from the unlocking operation of the casement bolt or espagnolette lock which is not shown. In addition, another essential requirement of this invention consists in that, starting from the unlocked position, the unlocking operation of the casement bolt or espagnolette lock results successively in the door or window being opened into a ventilation position, followed by complete inward opening. Therefore, according to one characteristic of this invention, the fitting comprises means 21 cooperating with the hinged fittings 1 to control, starting from the closed position, the opening of the door, window or the like in the aforementioned order.

According to a first embodiment, these means 21 essentially consist of a connecting rod 22 hinged at one of its ends 23 on to the top rail 8 or bottom rail 8A of the wing 9, while the other end 24 of this connecting rod 22 can be joined to the slide 14 by means of a driving finger 25.

The said connecting rod 22 is moreover provided with a controlling finger 26 forming a continuation of its end 23 hinged on to the said top rail 8 or bottom rail 8A, wherein a roller 27 integral with a controlling member 28, such as an operating rod actuated by the casement bolt or espagnolette lock can act on said controlling finger 26.

More precisely, in the closed position of the door, window or the like, the connecting rod 22 is disposed substantially in one vertical plane passing through the top rails 8, 16 and bottom rails 8A, 16A respectively of the wing 9 and the fixed frame 11. By actuating the control mechanism of the casement bolt or espagnolette lock by means of a handle, which is not visible, the controlling member or operating rod 28 has the function of rotating the connecting rod 22. In order to do this, the roller 27 integral with the said controlling member 28 cooperates with a flat stop 29 of said connecting rod 22, substantially offset in relation to the axis of rotation 30 of the latter. This results in rotation of the said connecting rod 22, which simultaneously causes, by means of its driving finger 25, rectilinear displacement of the slide 14 in the groove 15, thus actuating the principal stay arm 5. The wing 9 thus extends outside the fixed frame 11 and, preferably, towards the interior of the dwelling. This is the aeration position, also known as the ventilation position, of the door, window or the like.

In this connection, it is advisable to note that this fitting is adapted to give the wing 9 two types of ventilation position in relation to the fixed frame 11. The first, known as the tilted position, corresponds to the case where the actuation of the casement bolt or espagnolette lock results initially only in rotation of the connecting rod 22 corresponding to the casement stay 3. Simultaneously, the roller 27A executes an idle stroke 31, separating the roller 27A from the flat stop 29A (see FIG. 2), under the action of the controlling member 28 or operating rod acting once again on the corner bearing 2. This prevents rotation of the said connecting rod 22A and consequently holds the bottom rail 8A of the wing 9 against the bottom rail 16A of the fixed frame 11. To summarise, it is a matter of creating a delay between the drive of the connecting rod 22A of the corner bearing 2 and that 22 corresponding to the casement stay 3.

The second solution consists in ensuring that there are identical kinetics at the corner bearing 2 and the casement stay 3. For this reason, the unlocking action on the casement bolt or espagnolette lock results initially in a complete offset of the wing 9 in relation to the fixed frame 11.

When a ventilation position corresponding to tilted opening of the door, window or the like is selected, the complementary unlocking action on the casement bolt or espagnolette lock leads secondly to displacement of the wing 9 in relation to the fixed frame 11 at their bottom rails, this being by rotation of the connecting rod 22A.

In fact, whichever solution is adopted, this secondary action on the control mechanism of the casement bolt or espagnolette lock returns the wing 9 to a position in which it is completely released in relation to the fixed frame 11. Therefore, in order to ensure inward opening of the door, window or the like, it must be possible to destroy one of the connections connecting the connecting rods 22, 22A to the wing 9 and to the fixed frame 11.

To this end, and according to the embodiment of the invention illustrated in FIG. 1, the slide 14 comprises in one of its longitudinal edges 32 a slot 33, into which is inserted the driving finger 25 of the said connecting rod 22, 22A. Therefore, following rotation of the said connecting rod, resulting in the slide 14 sliding in the groove 15, the slot 33 of said slide 14 positions itself to the right of an opening 34 provided in the lateral wall 35 of the said groove 15. For this reason, the driving finger 25 of the connecting rod 22, 22A can be released laterally from the slide 14 and from the shaped section 17 or from the rail of the fixed frame 11 under the action of rotation of the wing 9 about a vertical axis corresponding to the axis of the hinges 7, 7A connecting the principal stay arms 5 of the corner bearing 2 and the casement stay 3 to the said wing 9.

On the other hand, when closing the door, window or the like once again, this driving finger 25 of the connecting rod 22, 22A once again engages the opening 34 then the slot 33 respectively of the lateral wall 35 of the groove 15 and the slide 14. In this connection, it is essential to note that in order to guarantee good positioning of the connecting rods 22 and 22A and, in particular, their driving finger 25 to the right of the openings 34 and slots 33, the said connecting rods 22 and 22A are locked in rotation by means of the rollers 27 and 27A cooperating with the controlling members 28 and 28A of the casement bolt or espagnolette lock. More precisely, these rollers 27 and 27A cooperate, in the completely open position of the casement bolt or espagnolette lock, with the flat stops 29 and 29A of the connecting rods 22 and 22A, preventing them from pivoting about their axis of rotation 30.

As described hereinabove, the peripheral aeration position corresponding to a complete offset of the wing 9 in relation to the fixed frame 11 is obtained, as the case may be, following a first actuation of the casement bolt or espagnolette lock or at the end of the unlocking operation of the latter. This second solution necessitates the use of secondary holding means disposed on the periphery of the wing 9 and preferably level with the front stile of said wing, in case it would be advantageous for the user to keep the said wing 9 in this aeration position without, however, allowing a stranger to enter the dwelling easily.

However, in the initial case, corresponding to displacement of the wing in relation to the fixed frame, obtained following a first actuation of the casement bolt or espagnolette lock, the arrangement of the rollers 27, 27A on the controlling members or operating rods 28, 28A with respect to the connecting rods 22, 22A can be fixed in such a way that in this intermediate position these connecting rods only rotate partially. Therefore, the displacement of the slide 14 would not be sufficient to allow its slot 33 to position itself to the right of the opening 34 provided in the groove 15. Consequently, the driving finger 25 of the connecting rods 22, 22A could not release itself from the said groove 15, thus preventing inward opening of the wing 9, as complete rotation of the connecting rods 22, 22A would only be obtained following complete unlocking of the casement bolt or espagnolette lock.

It was noted earlier in the description that the rotation of the connecting rods 22, 22A is obtained by the cooperation of a flat stop 29, 29A or a controlling finger 26 with a roller 27, 27A of an operating rod 28, 28A. However, other embodiments can be envisaged in order to ensure operation of this kind. As shown by way of example in FIG. 3, the connecting rod 22, having an identical configuration to that of a stay arm, can be provided at its end 36, pivotally mounted on the top rail 8 of the wing 9, with a toothed sector 37 adapted to cooperate with the teeth 38 of a rack 39 added to the end of the operating rod 28, 28A.

FIG. 3 moreover shows a principal stay arm 5 which is not bent, corresponding to another embodiment.

The advantage of fixing the connecting rods 22, 22A in rotation during inward opening of the door, window or the like was described hereinabove. However, the said groove 15, being fixed, constitutes the reference element in relation to which it is also advisable to fix the slide 14 in translation during the pivoting of the wing 9, as, if the connecting rods 22 and 22A can be offset within the context of this method of opening, then this possibility is also open to the slides 14.

To this end, the fitting according to the invention moreover comprises means 40 for fixing the slide 14 in translation 14 in relation to the groove 15 when the door or window is opened inwardly.

According to a first embodiment, illustrated in FIG. 1, these means 40 consist of a cam 41 hinged on to the slide 14 and comprising a fork 42 adapted to receive the driving finger 25 of the connecting rod 22, 22A. Therefore, both in the closed position and in the peripheral aeration or ventilation position, the fork 42 engages the said driving finger 25. In the case of inward opening of the wing of the door, window or the like, the action of the driving finger 25 on the said fork 42 leads to rotation of the cam 41. A stop pin 43 surmounting said cam then engages an opening 44 provided for this purpose in one of the lateral walls 45 of the groove 15. As a result, the slide 14 is fixed in translation in the said groove. On the other hand, when it engages the slot 33 of the slide 14, the driving finger 25 cooperates with one of the branches of the fork 42, resulting in inverse rotation of the cam 41 and, finally, the release of the pin 43 from the opening 44.

FIG. 4 shows another embodiment of these means 40 adapted to fix the slide 14 in translation in the said groove 15 in the inwardly open position of the door, window or the like. More precisely, in the case of this embodiment, the means 40 consist of a lever 46 hinged on to the slide 14, whose rotation in a given direction ensures that said slide is locked in translation in the groove 15.

Therefore, the lever 46 comprises, on the one hand, a controlling finger 47, adapted to be actuated by means of a driving finger 25 of the connecting rod 22 or 22A and, on the other hand, a blocking member 48 which can engage an opening 50 provided in one of the lateral walls 45 of the groove 15 and thereby fix the slide 14.

More precisely, the action of the driving finger 25 of the connecting rod 22, 22A on the controlling finger 47, in the closed or aeration position of the wing 9 leads to the release of the blocking member 48 from the opening 50, thereby allowing axial displacement of the slide 14. On the other hand, in the case of inward opening, suppression of the action of the driving finger 25 on the controlling finger 47 leads, under the impulsion of elastic means 51, to rotation of the lever 46 and, simultaneously, to engagement of the blocking member 48 in the opening 50.

The embodiment of the fitting according to the invention illustrated in FIGS. 5 and 6 will be used more particularly in the case of doors or windows having rabbets of reduced dimensions which would not be capable of receiving hinged fittings 1 realised according to the embodiments disclosed earlier in the description.

Therefore, according to this embodiment, the means 21 adapted successively to open the door, window or the like into a ventilation position, followed by complete inward opening, consist of a connecting rod 22A hinged at one of its ends 23 on to the bottom rail 8A or top rail 8, as the case may be, of the wing 9. The opposite end 24 of this connecting rod 22A is for its part connected, by means of a hinge 103, to a secondary lever arm 104. This secondary lever arm cooperates at its ends 105, 106 respectively with the wing 9 and the fixed frame 11.

The end 105 of this secondary lever arm 104 is slidably mounted in a carriage 107 provided either in a fixing plate or as a continuation 108 of a fore-end 109 provided on the bottom rail 8A or top rail 8 of the wing 9. The opposite end 106 of this secondary lever arm 104 is also slidably mounted on the bottom rail 16A or top rail 16 of the fixed frame 11. More precisely, this end 106 either cooperates, by means of a driving finger 112, with a second carriage 110 adapted to move in the groove 15 provided in the bottom rail 16A and top rail 16 of the fixed frame 11 or in a shaped section 17 added to this bottom rail 16A or top rail 16, or comprises a projection 112A engaging the said groove 15 and adapted to slide in the latter. It will be noted that FIG. 5 shows this second embodiment in more detail, while FIG. 6 corresponds to the embodiment described hereinabove.

So that the locking means and, in particular, the casement bolt or espagnolette lock can act on means 21 of the kind realised according to this third embodiment, the end 23 of the connecting rod 22A hinged on to the bottom rail 8A or top rail 8 of the wing 9 is provided with a controlling finger 26 forming an angle 111 with the longitudinal axis of said connecting rod. A roller 27A integral with a controlling member 28A, such as an operating rod, actuated by means of the casement bolt or espagnolette lock, acts on this controlling finger 26. Once again, this particular arrangement of the controlling finger 26 in relation to the connecting rod 22A makes it possible to reduce the space occupied by the latter in the rabbets of the fixed frame 11 and the wing 9 and, in any case, prevents the necessity to cut a slot into the covering lip 52 provided on said wing, as opposed to the connecting rod 22 according to the first embodiment.

Therefore, the fitting 1 operates as follows:

in the closed position of the door, window or the like, the connecting rod 22A is disposed substantially in one vertical plane passing through the bottom rails (8A, 16A) or top rails (8, 16) respectively of the wing 9 and the fixed frame 11;

by acting on the casement bolt or espagnolette lock (not visible in the drawings), the controlling member or operating rod 28A pushes the controlling finger 26 back, resulting in rotation of the said connecting rod 22A;

this connecting rod 22A simultaneously pushes back the secondary lever arm 104, the ends 105 and 106 of which slide in the carriage 107 and in the groove 15 provided respectively on the bottom rail 8A and top rail 8 of the wing 9 and on the bottom rail 16A and top rail 16 of the fixed frame 11. It will be noted that during the displacement of the secondary lever arm 104 and the connecting rod 22A, there is moreover the rotation of the principal stay arm 5 and displacement of the slide 14, to which its end 13 is connected, in the groove 15 provided in the bottom rail 16A and top rail 16 of the fixed frame 11.

The wing 9 then extends outside said fixed frame and, preferably, towards the interior of the dwelling, this corresponding to the position known as the ventilation position of the door, window or the like.

In this connection, it is advisable to note that, just as before, the fitting realised according to this embodiment can give the wing 9 two types of ventilation position in relation to the fixed frame 11. The first, known as the tilted position, corresponds to the case where actuation of the casement bolt or espagnolette lock results initially in rotation of the connecting rod situated in the upper rabbet of the door, window or the like. Simultaneously, the roller 27A of the controlling member or operating rod 28A, acting once again on the lower rabbet, executes an idle stroke 31 corresponding to the distance separating the said roller 27A from the controlling finger 26. As the connecting rod 22A associated with the corner bearing 2 is not acted upon under these conditions, the bottom rail 8A of the wing 9 is held against the bottom rail 16A of the fixed frame 11. Once again, a delay is created between the drive of the connecting rod 22A associated with the corner bearing 2 and that of the one situated in the upper rabbet of the door, window or the like.

The second solution consists in ensuring that the connecting rods have identical kinetics at the lower and upper rabbets of the wing 9 and fixed frame 11. For this reason, the unlocking operation of the casement bolt or espagnolette lock results initially in a complete offset of the wing 9 in relation to the fixed frame 11.

When a ventilation position corresponding to tilted opening of the door, window or the like is selected, a complementary unlocking operation of the casement bolt or espagnolette lock results secondly in displacement of the wing 9 in relation to the fixed frame 11 at their bottom rails 8A and 16A respectively, this being by rotation of the connecting rod 22A and displacement of the secondary lever arm 104.

In fact, whichever solution is adopted, this secondary actuation of the casement bolt or espagnolette lock returns the wing 9 to a position in which it is completely released on its periphery from the fixed frame 11.

Consequently, it must be possible to ensure that the door, window or the like is opened inwardly.

To this end, the groove 15 provided in the bottom rail 16A and top rail 16 of the fixed frame 11 comprises, as in the case of the embodiment illustrated in FIG. 1, an opening 34 provided in one of its lateral walls 35 and to the right of which there appears, after the unlocking operation of the casement bolt or espagnolette lock, either the driving finger 112 or the projection 112A provided on the end 106 of the secondary lever arm 104. Therefore, this driving finger 112 or projection 112A can be released laterally from the said groove 15 under the action of rotation of the wing 9 about a vertical axis corresponding to the axis of the pivot pin 7A, 7 to which is connected the principal stay arm 5. It will be noted that when a second slide 110 is used, disposed in the groove 15 and cooperating with the driving finger 112, this slide 110 also has, in one of its longitudinal edges, a slot which positions itself to the right of the opening 34 provided in the groove 15 after unlocking of the casement bolt or espagnolette lock, to allow lateral release of the said driving finger 112.

When the door, window or the like is closed once again, this driving finger 112 or this projection 112A of the secondary lever arm once again engages the opening 34 provided in the lateral wall 35 of the groove 15 and, if appropriate, in the slot provided in the second slide 110.

As a result of the locking in rotation of the connecting rods 22A disposed in the upper and lower rabbets of the wing 9 and the fixed frame 11, by means of the rollers 27A, good positioning of the driving finger 112 or projection 112A of the secondary lever arm 104 to the right of the opening 34 is ensured when the door, window or the like is closed.

However, when there is a slide 110 in the groove 15 cooperating with the driving finger 112 of the secondary lever arm 104, this slide 110 must be fixed in the said groove 15 during inward opening of the wing 9. This can be achieved with the aid of means 40, as described hereinabove in connection with the embodiments illustrated in FIGS. 1 to 4.

As already indicated hereinabove, the peripheral aeration position corresponding to a complete offset of the wing 9 in relation to the fixed frame 11 is obtained, as the case may be, following a first actuation of the casement bolt or espagnolette lock or during a second actuation of same.

Whichever solution is adopted, in a peripheral aeration position of this kind, the arrangement of the rollers 27A on the controlling members or operating rods 28A in relation to the connecting rods 22A can be fixed in such a way that the said connecting rods 22A only effect a partial rotation. Therefore, the displacement of the driving finger 112 or projection 112A of the secondary lever arm 104 would not be sufficient to allow it to position itself to the right of the opening 34 provided in the groove 15, thereby preventing inward opening of the wing 9, as complete rotation of the connecting rods 22A would only be obtained after complete unlocking of the casement bolt or espagnolette lock.

In this connection, it is likely that in certain cases this complementary actuation of the casement bolt or espagnolette lock would only result in a reduced amplitude of rotation of the connecting rods 22 and 22A and that under these conditions, the intermediate unlocking position could not be precisely defined.

In order to mitigate this disadvantage, there are provided means 113, on the one hand, for preventing inward opening of the wing 9 when the latter is in the peripheral aeration position, known as the ventilation position, and, on the other hand, for reducing the action of the connecting rod 22A on the said secondary lever arm 104 at the end of the unlocking operation of the casement bolt or espagnolette lock. More precisely, these means 113 consist of an opening 114 in the form of a comma abutting on the end 115 of the carriage 107 in which the end 106 of the said secondary lever arm 104 moves. This opening 114 in fact forms an angle 116 in relation to the carriage 107 such that this end 106 of the secondary lever arm 104 moves away from the fixed frame 11 at the end of the rotational movement of the connecting rod 22A. This results in additional displacement of the end 105 of the said secondary lever arm 104 in the groove 15 in such a way that the driving finger 112 or the projection 112A is positioned to the right of the opening 34 provided in the lateral wall 35 of this groove 15.

In order to facilitate understanding of the operation of this fitting, the different positions that can be occupied both by the end 105 of the secondary lever arm 104 in the carriage 107 and by the roller 27A integral with the controlling member 28A in relation to the connecting rod 22A have been marked on FIG. 5.

Therefore, the reference marks 117, 118 indicate the position of this end 105 and of the roller 27A at the lower rabbet, while the reference marks 117 and 119 correspond to the position of this end of the secondary lever arm 104 and of the roller 27 positioned in the upper rabbet, this being when the door or window is completely locked.

After a first actuation of the casement bolt or espagnolette lock corresponding, e.g. to tilted opening of the wing 9, only the roller 27A at the lower rabbet is displaced so that it occupies the marked position 119. On the other hand, in the upper rabbet, both the end 105 of the secondary lever arm 104 and the roller are displaced so that they then occupy the marked positions 120 and 121.

Following a second actuation of the casement bolt or espagnolette lock, the wing 9 moves into a peripheral aeration position in relation to the fixed frame 11. This leads to additional displacement of the roller and of the end 105 of the secondary lever arm 104, situated in the upper rabbet, returning them to the marked positions 122 and 123. It will be noted in this connection that this end 105 of the secondary lever arm 104 engages the opening 114 abutting on the carriage 107, and the driving finger 112 or the projection 112A is positioned to the right of the opening 34 provided in the groove 15 provided on the top rail of the fixed frame 11. The end 105 of the said secondary lever arm 104 and the end of the roller 27A disposed in the lower rabbet occupy the marked positions 120 and 121 respectively.

During a third actuation of the casement bolt or espagnolette lock, for inward opening of the wing 9, only the roller at the top rail of said wing effects an additional translatory movement in order to reach the reference mark 124. Moreover, the end 105 of the secondary lever arm 104 and the roller 27A, situated at the bottom rails 8A and 16A respectively of the wing 9 and the fixed frame 11 are displaced in order to come into the marked positions 122 and 123. The driving finger 112 or the projection 112A then comes into a position to the right of the opening 34 of the groove 15 provided at the bottom rail 16A of the fixed frame 11.

In conclusion, with this invention it is possible to mitigate all of the disadvantages of known fittings, particularly for pivoting and tiltable wings. Therefore, the invention provides a solution to the problem posed by the opening angle of the wing in relation to the fixed frame when a corner bearing and a casement stay are inserted in the rabbets. It is also possible, starting from the closed position, to achieve inward opening, passing through an intermediate aeration position. In addition, it allows the adoption of two different methods of partial opening.

Finally, it will be noted that the fitting according to the invention can be applied to any kind of rabbet of a door, window or the like by virtue of the reduced space occupied by said fitting and better distribution of weight over the elements constituting said fitting.

I claim:

1. Fitting for doors, windows or the like, comprising a locking member or operating rod for locking the wing (9) against the fixed frame (11), and acting on hinged fittings consisting of a corner bearing and a casement stay disposed in rabbets, so that the said wing (9) can be opened at least inwardly and disposed in a ventilation position, this fitting comprising control means (21) for opening the wing (9), starting from the closed position, into the ventilation position, followed by inward opening of said wing, by acting successively on the locking member or operating rod (28, 28A).

2. Fitting according to claim 1, comprising a corner bearing (2) and a casement stay (3) each consisting of, on the one hand, a principal stay arm (5) disposed in a rabbet and connected at one of its ends (6) and by means of a hinge (7, 7A) to the bottom rail (8A) or top rail (8) of the wing (9), the other end (13) of the said principal stay arm (5) cooperating with the bottom rail (16A) or top rail (16) of the fixed frame (11), and, on the other hand, a secondary arm (19) hinged at one of its ends (20) on to the said bottom rail (16A) or top rail (16) of the fixed frame (11) and connected at its opposite end to the principal stay arm (5).

3. Fitting according to claim 1, consisting of a corner bearing and a casement stay, each comprising a principal stay arm (5) connecting the bottom rail (8A) or top rail (8) of the wing (9) to the bottom rail (16A) and top rail (16) of the fixed frame (11), this principal stay arm (5) comprising an end (13) pivotally mounted on a slide (14) moving in a groove (15) provided either in the bottom rail (16A) and top rail (16) of the fixed frame (11), or in a shaped section (17) added to the said bottom rail (16A) and top rail (16).

4. Fitting according to claim 1, comprising a corner bearing and a casement stay consisting of a principal stay arm (5) and a secondary arm (19) connecting the bottom rail (8A) or top rail (8) of the wing (9) to the bottom rail (16A) or top rail (16) of the fixed frame (11), the said principal stay arm (5) comprising an end (6) hinged on to the bottom rail (8A) or top rail (8) of the said wing (9) as close as possible to the rear edge (10) of the latter, this end (6) moreover being bent at a right angle in order, in the inwardly open position, to follow the exact shape of the profile constituting the rear stile (12) of the said wing (9) and, in particular, the covering lip (52) provided thereon, and allowing an opening angle substantially equal to 180 degrees.

5. Fitting according to claim 1, comprising a corner bearing and a casement stay, each consisting of a principal stay arm (5) and a secondary arm (19) connecting the bottom rail (8A) or top rail (8) of the wing (9) to the bottom rail (16A) or top rail (16) of the fixed frame (11), the said principal stay arm (5) being curved and comprising in its central portion (18) and on its lateral edge (100) having a small radius of curvature, an eyelet (101) playing a part in the connection with the end (20A) of the secondary arm (19).

6. Fitting according to claim 1, comprising a corner bearing and a casement stay connecting the wing of a door, window or the like to its fixed frame, this fitting comprising control means (21) for opening the wing (9), starting from the closed position, into the ventilation position, followed by inward opening of said wing, by acting successively on a locking member or operating rod, the said means (21) consisting of a connecting rod (22, 22A) hinged at one of its ends (23) on to the top rail (8) and bottom rail (8A) of the wing (9), its other end (24) cooperating by means of a driving finger (25) with a slide (14) moving in a groove (15) provided either in the bottom rail (16A) and top rail (16) of the fixed frame (11), or in a shaped section (17) added to the said bottom rail (16A) and top rail (16).

7. Fitting according to claim 6, comprising a locking member or operating rod for locking the wing (9) against the fixed frame (11) by acting on hinged fittings consisting of a corner bearing (2) and a casement stay (3), this fitting being provided with control means (21) for opening the wing (9), starting from the closed position, into the ventilation position, followed by inward opening of said wing, by acting successively on the locking member or operating rod, the said means (21) consisting of a connecting rod (22, 22A) comprising at its end (23), on the one hand, a controlling finger (26) and, on the other hand, a flat stop (29, 29A) adapted to cooperate with the said locking member or operating rod (28, 28A) in order to rotate the said connecting rod (22, 22A).

8. Fitting according to claim 6, comprising a locking member or operating rod for locking the wing (9) against the fixed frame (11) by acting on hinged fittings consisting of a corner bearing and a casement stay, this fitting comprising control means (21) for opening the wing (9), starting from the closed position, into the ventilation position, followed by inward opening of said wing, by acting successively on the said locking member or operating rod, these means (21) consisting of a connecting rod (22, 22A) comprising at its end (36) a toothed sector (37) cooperating with a rack (39) added to the end of the locking member or operating rod (28, 28A) in order to rotate the said connecting rod (22, 22A).

9. Fitting according to claim 6, comprising a locking member or operating rod for locking the wing (9) against the fixed frame (11) by acting on hinged fittings consisting of a corner bearing (2) and a casement stay (3), this fitting comprising a connecting rod (22, 22A) hinged at one of its ends (23) on to the top rail (8) and bottom rail (8A) of the wing (9), its other end (24) cooperating by means of a driving finger (25) with the slide (14) of the casement stay (3) and of the corner bearing (2), the said connecting rod (22, 22A) being provided at its end (23), on the one hand, with a controlling finger (26) and, on the other hand, with a flat stop (29, 29A) adapted to cooperate with the locking member or operating rod (28, 28A) in order to rotate the said connecting rod (22, 22A), in the closed position, this locking member or operating rod (28A) having an idle stroke (31) with respect to the flat stop (29A) of the connecting rod (22A) corresponding to the corner bearing (2) in order to cause a delay between the drive of the said connecting rod (22A) and that of the connecting rod (22) of the casement stay (3) under the action of the said locking member or operating rod, and to give the wing (9) a ventilation position corresponding to a tilted open position.

10. Fitting according to claim 6, comprising a locking member or operating rod for locking the wing (9) against the fixed frame (11) by acting on hinged fittings consisting of a corner bearing (2) and a casement stay (3), this fitting comprising a connecting rod (22, 22A) hinged at one of its ends (23) on to the top rail (8) and bottom rail (8A) of the wing (9), its other end (24) cooperating by means of a driving finger (25) with a slide (14) moving in a groove (15) provided either in the bottom rail (16A) and top rail (16) of the fixed frame (11), or in a shaped section (17) added to the said bottom rail (16A) and top rail (16), this slide (14) comprising in one of its longitudinal edges (32) a slot (33) receiving the driving finger (25) of the connecting rod (22, 22A) and positioning itself, after the unlocking operation of the wing (9) and in a peripheral ventilation position of the latter, to the right of an opening (34) provided in the lateral wall (35) of the groove (15) provided in the bottom rail (16A) and top rail (16) of the fixed frame (11), allowing lateral release of the said driving finger (25) and ensuring that the door, window or the like is opened inwardly.

11. Fitting according to claim 9, comprising means (40) for fixing the slide (14) in translation in the groove (15) and keeping the slot (33) to the right of the opening (34) during inward opening, the said means (40) consisting of a cam (41) hinged on to the slide (14) and comprising, on the one hand, a fork (42) adapted to receive the driving finger (25) of the connecting rod (22, 22A) in the closed or ventilation position of the wing (9) and, on the other hand, a stop pin (43) adapted to cooperate with an opening (44) provided in one of the lateral walls (45) of the groove (15) following rotation of the cam (41) caused by inward opening of the said wing (9).

12. Fitting according to claim 10, comprising means (40) for fixing the slide (14) in translation in the groove (15) and keeping the slot (33) to the right of the opening (34) when the door or window is opened inwardly, the said means (40) consisting of a lever (46) hinged on to the slide (14) and comprising, on the one hand, a controlling finger (47) cooperating with the driving finger (25) of the connecting rod (22, 22A) in the closed or ventilation position of the wing (9) and, on the other hand, a blocking member (48) adapted to engage an opening (50) provided in one of the lateral walls (45) of the groove (15) following rotation of the said lever (46) under the impulsion of elastic means (51) and when the wing (9) is opened inwardly.

13. Fitting according to claim 1, comprising a locking member or operating rod for locking the wing (9) against the fixed frame (11), and acting on hinged fittings consisting of a corner bearing (2) and a casement stay (3), each comprising a principal stay arm (5) and a secondary arm (19) connecting the bottom rail (8A) or top rail (8) of the wing (9) to the bottom rail (16A) or top rail (16) of the fixed frame (11), this fitting being provided with control means (21) for opening the wing (9), starting from the closed position, into the ventilation position, followed by inward opening of said wing, by acting successively on the locking member or operating rod, these means (21) consisting of a connecting rod (22A) hinged at one of its ends (23) on to the top rail (8) or bottom rail (8A) of the wing (9), its opposite end (24) cooperating with a secondary lever arm (104) connected at its ends (105, 106) respectively to the wing (9) and the fixed frame (11).

14. Fitting according to claim 13, one of the ends (105) of the secondary lever arm (104) being slidably mounted in a carriage (107) provided either in a fixing plate, or as a continuation (108) of a fore-end (109) provided on the top rail (8) or bottom rail (8A) of the wing (9), the other end (106) being slidably mounted on the top rail (16) or bottom rail (16A) of the fixed frame (11).

15. Fitting according to claim 13, the end (106) of the secondary lever arm (104) cooperating by means of a driving finger (112) with a second slide (110), adapted to move in a groove (15) provided either directly in the top rail (16) or bottom rail (16A) of the fixed frame (11), or in a shaped section (17) added to this top rail (16) or bottom rail (16A).

16. Fitting according to claim 13, the end (106) of the secondary lever arm (104) comprising a projection (112A) engaging a groove (15) provided in the top rail (16) or bottom rail (16A) of the fixed frame (11) or in a shaped section (17) added to this top rail (16) or bottom rail (16A).

17. Fitting according to claim 13, the connecting rod (22A) comprising a controlling finger (26) forming an angle (111) with the longitudinal axis of said connecting rod and adapted to cooperate with a roller (27A) integral with the locking member or operating rod (28A).

18. Fitting according to claim 13, comprising means (113), on the one hand, for preventing inward opening of the wing (9) when the latter is in the ventilation position, and, on the other hand, for reducing the action of the connecting rod (22A) on the said secondary lever arm (104) at the end of the unlocking operation of the locking member or operating rod (28A).

19. Fitting according to claim 18, comprising a locking member or operating rod for locking the wing (9) against the fixed frame (11) by acting on hinged fittings consisting of a corner bearing (2) and a casement stay (3), this fitting comprising control means (21) for opening the wing (9), starting from the closed position, into the ventilation position, followed by inward opening of said wing, these means consisting of a connecting rod (22A) hinged at one of its ends (23) on to the top rail (8) or bottom rail (8A) of the wing (9), its opposite end (24) cooperating with a secondary lever arm (104) connected at its ends (105, 106) respectively to the wing (9) and the fixed frame (11), the end (105) of the said secondary lever arm (104) being slidably mounted in a carriage (107) provided either in a fixing plate, or as a continuation (108) of a fore-end (109) provided on the top rail (8) or bottom rail (8A) of the wing (9), the said fitting moreover being provided with means (113) for preventing inward opening of the wing (9) when the latter is in the ventilation position, and secondly, for reducing the action of the connecting rod (22A) on the said secondary lever arm (104) at the end of the unlocking operation of the locking member or operating rod, the said means (113) consisting of an opening (114) in the form of a comma abutting on the end (115) of the carriage (107) in which the end (106) of the secondary lever arm (104) moves, this opening (114) forming an angle (116) in relation to the longitudinal axis of the said carriage (107) so that the said end (106) of the secondary lever arm (104) moves away from the fixed frame (11) at the end of the unlocking operation and, finally, resulting in additional displacement of the end (105) of this lever arm (104) in the groove (15) provided in the top rail (16) or bottom rail (16A) of the fixed frame (11).

* * * * *